United States Patent [19]

Peterson

[11] 4,120,085

[45] Oct. 17, 1978

[54] BEAM TYPE PLANAR ARRAY ANTENNA METHOD OF FABRICATION

[75] Inventor: Robert K. Peterson, Garland, Tex.

[73] Assignee: Texas Instruments Incorporated, Dallas, Tex.

[21] Appl. No.: 712,425

[22] Filed: Aug. 6, 1976

Related U.S. Application Data

[62] Division of Ser. No. 547,899, Feb. 7, 1975, Pat. No. 3,987,451.

[51] Int. Cl.[2] ..... H01Q 13/10; H01P 11/00

[52] U.S. Cl. ..... 29/600; 343/771

[58] Field of Search ..... 343/770, 771; 29/600

[56] References Cited

U.S. PATENT DOCUMENTS

| | | | |
|---|---|---|---|
| 2,479,209 | 8/1949 | Chu | 343/771 |
| 2,628,311 | 2/1953 | Lindenblad | 343/771 |
| 2,981,948 | 4/1961 | Kurtz | 343/771 |
| 3,701,162 | 10/1972 | Seaton | 343/771 |

*Primary Examiner*—Eli Lieberman

*Attorney, Agent, or Firm*—Rene' E. Grossman; Alva H. Bandy

[57] ABSTRACT

An improved planar (flat plate) array antenna system and method of fabrication is disclosed. A planar array antenna or array is mounted in a support for stabilization against roll and pitch movements with a rotary joint providing uninterrupted radar operation. The array is scanned in azimuth up to 120 rpm with elevation or tilt control. The support arrangement is a four gimbal arrangement providing for a high r-f gain to swept volume ratio for a forward looking radar with fast azimuth scan. The array comprises a front plate and a back plate attached to spaced flanged beams and end shorts for forming a plurality of RF energy cavities. The front plate has radiation output ports (shunt slots) covered with a Kapton layer for closing the array cavities against moisture and to permit pressurization to prevent arcing. The back plate has power divider slots (series slots) over which a manifold is disposed for distributing RF energy into the array. The flanges of the flanged beams provide the increased bonding area necessary to retain the front and back plates during cavity pressurization.

2 Claims, 7 Drawing Figures

AZIMUTH 42
27
34
27
36
35
43
37
45 39
PITCH
16
44
32 27
28
72
30
ROLL
41
41
30
48
50
74
TILT
52
40
46
54
70
68
22
10
20
24
66
12
14

BEAM TYPE PLANAR ARRAY ANTENNA METHOD OF FABRICATION

This is a division of application Ser. No. 547,899, filed Feb. 7, 1975.

This invention relates to radar antennas and more particularly to an improved planar (flat plate) array antenna system and method of array fabrication.

In the past, planar (flat plate) array antennas have been fabricated by hogging a metal substrate to form a plurality of cavity forming walls to which a top plate or radiating energy plate is bonded. The bottom walls of the cavities form a back plate. Power distribution ports are machined in the back plate and an RF distribution manifold is attached. The bonding of the front plate to the thin cavity walls of the substrate results in a bond whose strength is insufficient to withstand pressurization to prevent arcing when high power is used. Pressurization to prevent arcing has been accomplished with the use of a pressure dome. The pressure dome is a curved structure that is attached to the outside of the planar array. It adds weight to the system, causes an RF loss, and requires strengthening of the front and back plate structures to withstand the pressure loading. The radar dome also limits the geometry of the linear array to circular arrays to provide a practical structure. The pressure dome approach therefore has the disadvantages of adding cost and complexity to the planar array antenna.

When power is not high enough to require pressurization, a r-f pressure window is placed either over the manifold feed slots or at some point further back in the system, and a desiccant is then used to absorb moisture accumulating in the unpressurized planar array.

Accordingly, an object of the present invention is to provide a planar or flat plate array antenna system having high gain to swept volume ratio.

Another object of the invention is to provide a method of fabricating a high efficiency planar array antenna.

Still another object of the invention is to provide a lightweight planar array antenna which is of simple construction and of light weight.

Yet another object of the invention is to provide a planar array antenna which eliminates the requirement for either a pressure dome for pressurization to enable the antenna to use high power or a desiccant and window cover for low power.

Still yet another object of the invention is to provide a planar array antenna fabrication jig including an arrangement for incorporating internal shorts into the array.

A further object of the invention is to provide a waveguide short for externally closing the array cavities formed with a planar array antenna fabrication jig.

Briefly stated, the invention comprises fabricating an improved planar array antenna from four basic parts: Firstly, a front plate; second, a back plate; third, a plurality of flanged beams; and fourth, a plurality of external end shorts and where required, internal shorts. Using the novel jig and method hereinafter described in greater detail, the front and back plates are bonded to the flanges of spaced beams and, where used, to the flanges of internal shorts, to form the cavities. After removal of the jig, the end shorts are bonded to the outer periphery of the array to close the array cavities, completing array fabrication. The frequency of the RF energy dictates the height of the flanged beams. The flanged areas of the beam can be varied to provide a bond area adequate for the pressure required in high power radars. To maintain the pressure without using a pressure dome and to eliminate the need for a desiccant, an r-f transparent film is bonded over the radiation slots of the front plate. The array after fabrication is mounted in a support having a gimbal arrangement, hereinafter described in detail, providing for a high r-f gain to swept volume ratio.

The novel features of the invention are pointed out with particularity in the appended claims. However, the invention itself, together with further objects and advantages thereof, may best be understood by reference to the following description taken in conjunction with the accompanying drawings in which:

Figure 1:
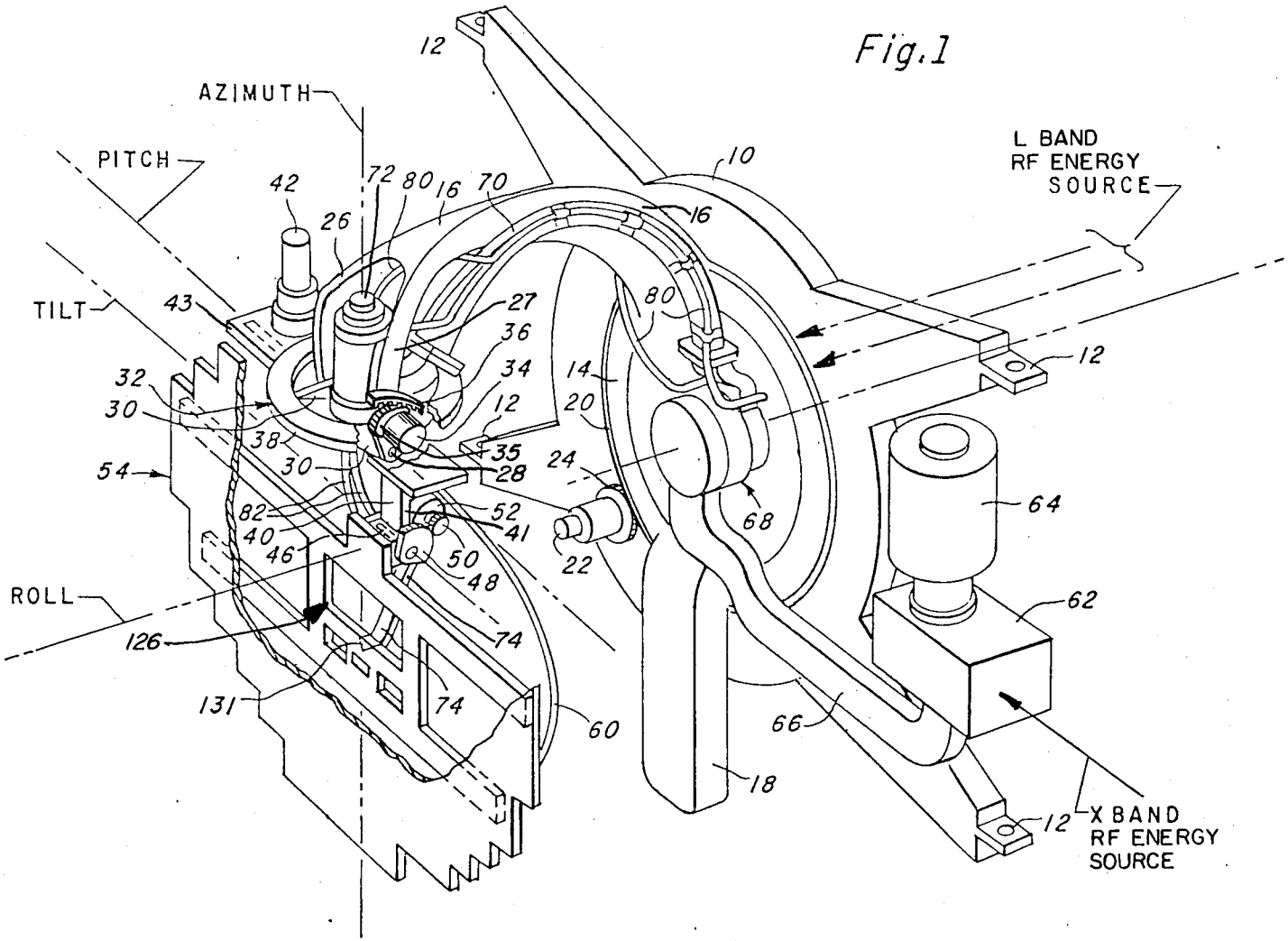
FIG. 1 is an isometric view of the improved flat plate or planar array antenna system constituting the subject matter of this invention.

Referring to the drawings for a description of a preferred embodiment of the invention, the flat plate array radar antenna system (FIG. 1) is designed for use in a vehicle such as, for example, an aircraft or spacecraft. A support member 10 has ears 12 for attaching the support member to an airframe in a position normal to the aircraft roll axis with its center point centered parallel to the roll axis for a purpose hereinafter described. The ears 12 are attached to the aircraft in any suitable manner such as, for example, by bolting the ears 12 to the airframe. A circular plate gear 14, having ends of an arcuate arm 16 and a counterweight 18 oppositely disposed to each other and formed, for example, integrally with the circular plate gear adjacent its periphery, is mounted on roll bearing 20 of the support member 10 with the arcuate arm and counterbalance positioned in the normal or vertical (yaw) axis of the aircraft when the aircraft is flying straight and level. A servo motor 22, mounted upon the support 10, is coupled through gear 24 to drive the circular plate gear 14 balanced by the counterbalance about the roll axis responsive to roll signals. The roll signals are received from the aircraft guidance system and actuate the servo motor 22 to maintain the normal position of the arcuate arm through a preselected roll angle.

The arcuate arm 16 terminates in a bifurcated end 26; the tynes 27 (FIG. 1a) of which are disposed vertically to the pitch axis of the aircraft. Pitch bearings (not shown) are journaled in the tynes 27 to rotatably support fasterners such as, for example, shoulder screws 28. An azimuth scanning platform assembly 32 has a pair of ears 30 having threaded apertures to receive the shoulder screws 28. The shoulder screws 28 rotatably mount the azimuth platform assembly 32 on the tynes 27 of the arcuate arm. A servo motor 34 is mounted upon a plate 37 of the azimuth scanning platform assembly 32 and has a gear 35 coupled to segment gear 36 attached to a tyne 27 of the arcuate arm 16. The motor 34 actuates gears 35 and 36 to drive the azimuth platform assembly 32 responsively to pitch signals received from the aircraft guidance system to maintain the normal position of the azimuth platform assembly 32 through a preselected pitch angle.

The azimuth scanning platform assembly 32 further includes a horizontally disposed azimuth plate 38 which supports interiorly thereof an azimuth bearing plate 39. An antenna array support member 40 has members 41 attached to the azimuth bearing plate 39 for 360° rotation therewith. A synchronous motor 42 is mounted upon a plate 43 forming an extension of the horizontally disposed azimuth plate 38. Drive gear 44 of motor 42 meshes with gear 45 of the azimuth bearing plate 39 to rotate in azimuth the array support member 40 at a preselected rate such as, for example, either 12 rpm or 120 rpm. A control transmitter (not shown) is driven synchronously with the azimuth rotation and provides an output of the antenna azimuth bearing. The other end of members 41 of the array support member 40 houses tilt bearings (not shown) to rotatably support one end of an antenna array attachment member 46. A vertically disposed sector gear 48 is secured to the array attachment member. The sector gear is driven by a power take off gear 50 of a servo motor 52 mounted on one of the members 41 of support member 40. The servo motor drives the antenna gears to tilt the array support member about a pitch axis.

An antenna array or array 54 is attached at its center point to the other end of the array attachment member 46. The length of the arcuate arm 16 is such that the center point of the array lies on the roll axis. Thus when the array attachment member 46 is rotated by the servo motor 52, the array is tilted about an axis which is parallel to the pitch axis and which passes through the array center point. Further, as the array support member 40 of the azimuth scanning platform assembly 32 is rotated about the azimuth bearing by servo motor 42, the antenna array is rotated about the azimuth axis which passes through the array center point and center of the azimuth platform assembly. With the center points of the circular plate gear 14, array 54, and the array tilt attachment member 46 on the roll axis, and the azimuth axis passing through the array center point, all that is necessary for the arrangement to achieve maximum theoretical high gain to swept volume ratio is to position the pitch axis of the arcuate arm 16 at the center point of the roll axis. This is not possible because of interference with the antenna array; therefore, the array 54 is cut away to form a notch 56 (FIG. 3) which extends downwardly to a point where further cutting would substantially degrade array performance. This positions the pitch axis as close as practicable to the roll axis to provide the highest possible high r-f gain to swept volume ratio for a 360° scanning, forward looking radar antenna. The antenna array 54 completes the system; however, where desired an IFF (identification friend or foe) antenna 60 (FIGS. 1 and 2) which may be, for example, a two channel L-band antenna, can be attached to the back side of the antenna array attachment member 46.

The antenna array 54 (FIGS. 1 and 1a), which may be, for example, a X band array and two channel IFF antenna 60 are fed r-f energy as follows. A source (not shown) of r-f energy at X band frequencies is connected to an r-f waveguide switch 62. The r-f waveguide switch 62 is operably responsive to control signals to switch the r-f energy between an r-f load 64 and waveguide 66. The r-f load 64 is used to dissipate any r-f energy generated while the aircraft is on the ground. The waveguide 66 couples the r-f energy to a single channel rotary joint 68 attached to the center of the circular plate gear 14 about the roll axis to permit uninterrupted feeding of r-f energy during aircraft roll. From the rotary joint 68 the X-band r-f energy passes through a flexible waveguide section 70 passing through a passage in the arcuate arm 16 to an X-band channel of a second rotary joint 72. The second rotary joint contains an X-band channel and two L-band channels in a stacked configuration as taught in U.S. Pat. No. 3,914,715 issued Oct. 21, 1975. The second rotary joint 72 is attached between the ears 30 of the azimuth platform assembly 32 on the aximuth center line and it extends upwardly through the azimuth platform plate 38. A flexible waveguide 74 (FIG. 1a) attached to the X-band port of the rotary joint 72 feeds the r-f energy to the antenna array manifold port.

Figure 2:
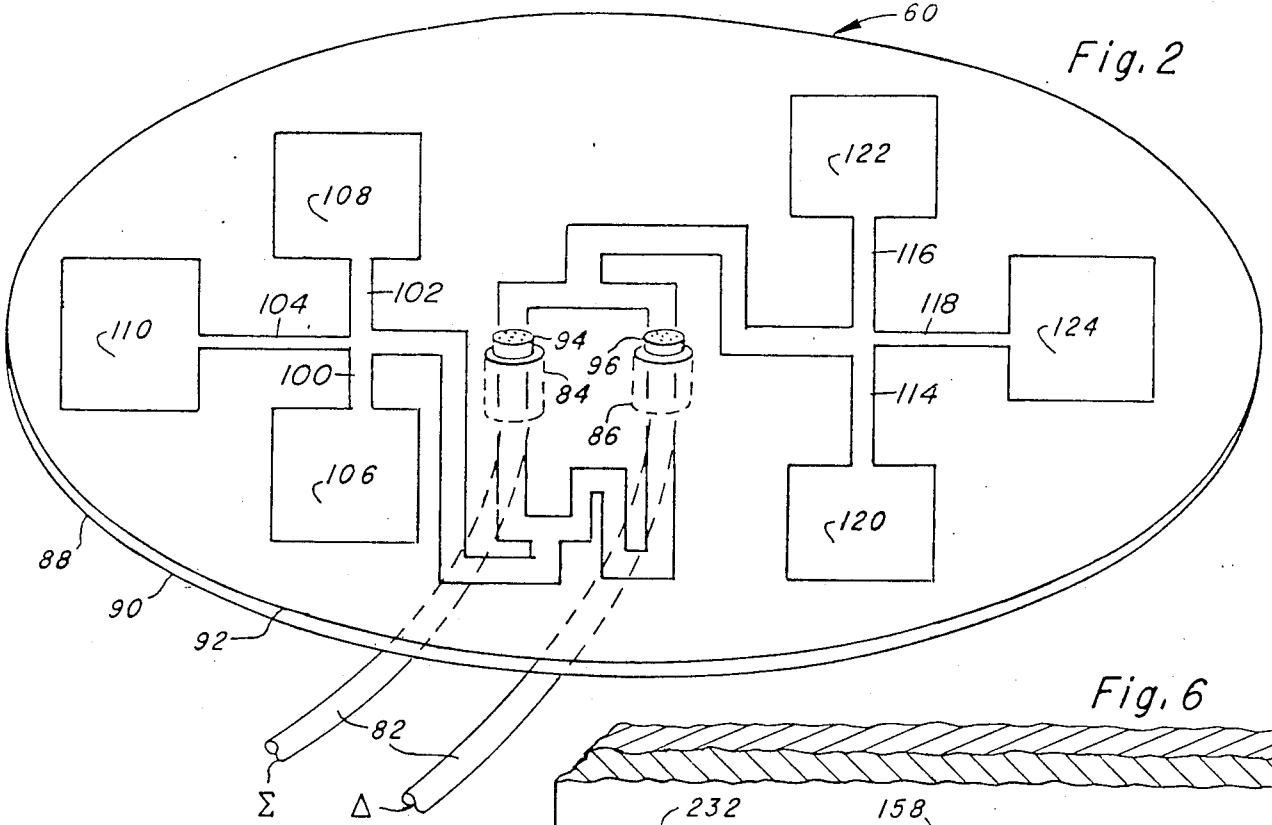
FIG. 2 is an isometric view of the L-band antenna.

The r-f energy at L-band frequencies (FIG. 1) is fed from a source thereof through flexible coaxial cables (not shown) through the circular plate gear 14 adjacent to the first rotary joint 68. Flexible coaxial cables 80 receive the r-f energy from the flexible coaxial cables and are attached to the arcuate arm 16 feed the r-f energy to the L band channels of the second rotary joint 72. Flexible coaxial cables 82 (FIGS. 1 and 2) interconnect the L-band output ports of the second rotary joints to the r-f connectors 84 and 86 of the two channel IFF antenna (FIG. 2). In operation the X-band and L-band radars are alternately pulsed during each revolution; that is, the X-band array is pulsed when it is looking forward from 0° to 180° during which time the L-band antenna is turned-off during 180° to 360°. Then the X-band array is cut-off from 180° to 360° and the L-band antenna is pulsed for 0° to 180°.

The fabrication of the L-band, two channel antenna will first be described, and then the X-band array. The L-band, two channel antenna comprises (FIG. 2) a sum channel for a pencil beam and an azimuth monopulse beam fabricated as follows: a substrate 88 of a suitable dielectric material such as a phenolic plastic, has a metal (e.g. copper) coated or layered side 90 and a circuit bearing side 92. The copper coated side 90 forms a ground plane for the antenna strip line circuitry. The coaxial connectors 84 and 86 are attached by any suitable means to the substrate 88 and pass through holes in the substrate with their terminals connected to r-f energy connectors 94 and 96 on the circuit side of the substrate for the sum and difference channels, respectively. The sum channel feeds radiators 106, 108, 110, 120, 122, and 124 in phase. Line width of leads 100, 102, 104, 114, 116, and 118 determines, respectively, power division to each radiator. The difference channel feeds radiators 106, 108, and 110 180° out of phase with radiators 120, 122, and 124. It is to be understood that different circuit arrangements can be made for different radiation patterns.

Figure 1A:
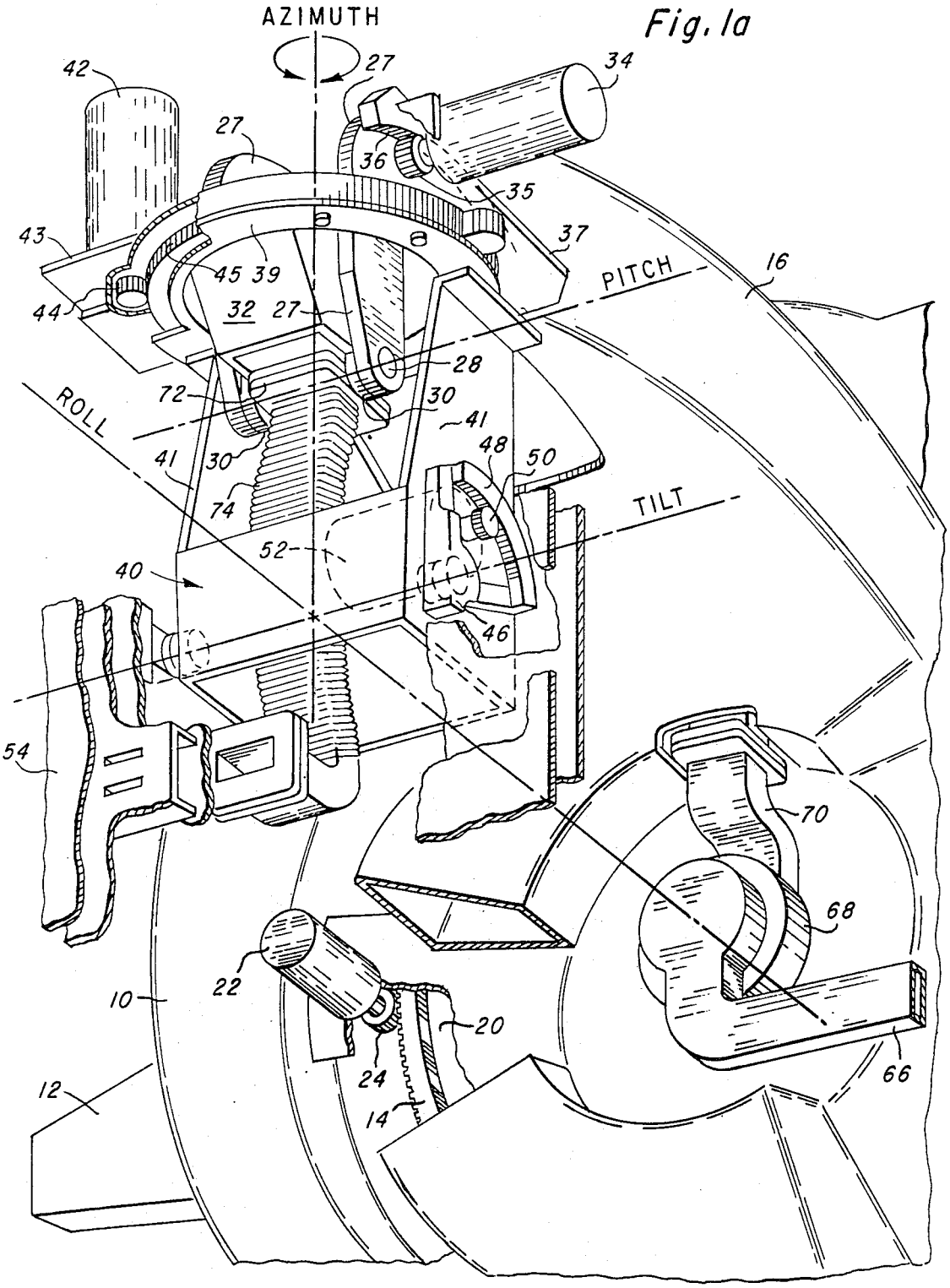
FIG. 1a is a partial isometric view of the antenna system of FIG. 1 with portions cut away to show the roll, pitch, azimuth and tilt adjusting mechanism and antenna feed.

As to the X-band array antenna, RF energy enters the flanged plate antenna 54 through a manifold 126 (FIGS. 1 and 3) bonded or otherwise attached to the back plate thereof. As shown, the manifold 126 distributes RF energy to four quadrants; however, a single oval antenna or more than a four quadrant array may be fed without departing from the present invention. The manifold can be designed to include multiple ports for azimuth and elevation monopulse operation. Electrical performance requirements such as, for example, the desired bandwidth and beam shape determine the feed arrangement. Persons skilled in the design of planar arrays are familiar with this technology; therefore, a detailed description is not included. Those persons interested in a more detailed description of determining particular feed arrangement types are referred to Skolnik's *Radar Handbook* 1970, Chapter 9. The manifold 126 (FIG. 3) is, for example, an X-band manifold and comprises a centrally disposed T-shaped member 128 having a port 130 adapted to be coupled to the flexible waveguide 74 (FIG. 1). A bend stub 131 is mounted in the port 130 for directing the RF energy along the leg of the T member to its cross member without substantial energy loss or mode change. The cross member is provided with a centrally disposed matching pin 132 (FIG. 3) for dividing the energy and directing it into the arms of the cross member. More energy can be directed into one arm than the other by varying the camber of the intersection of one side of the leg of the T member and its corresponding arm member from the camber of the intersection of the opposite side of the leg of the T member and its arm intersecting member. Tuners 134 are provided to match the RF energy leaving the cross member into the legs of T members 136 and 138. Except for a bend stub, which is not required, and additional RF energy port the T members 136 and 138 are constructed in accordance with the structure of T member 130 and need not be described again. Tuners 140 are provided in manifold waveguide members 142 and 144 adjacent to the ends of cross members of the T shaped members 138 and 136 to match the RF energy departing them. The manifold waveguide members 142 and 144, if desired for a particular design, can be divided into tuned cavities 142*a* and *b* and 144*a* and *b*, respectively, by depending vertical legs of T shaped block members 146 and 148. The vertical members act as shorts. The outer ends of members 142*a* and *b* and 144*a* and *b* are also closed to form shorts. The manifold 126 provides RF energy for radiation by the planar array antenna.

Figure 3:
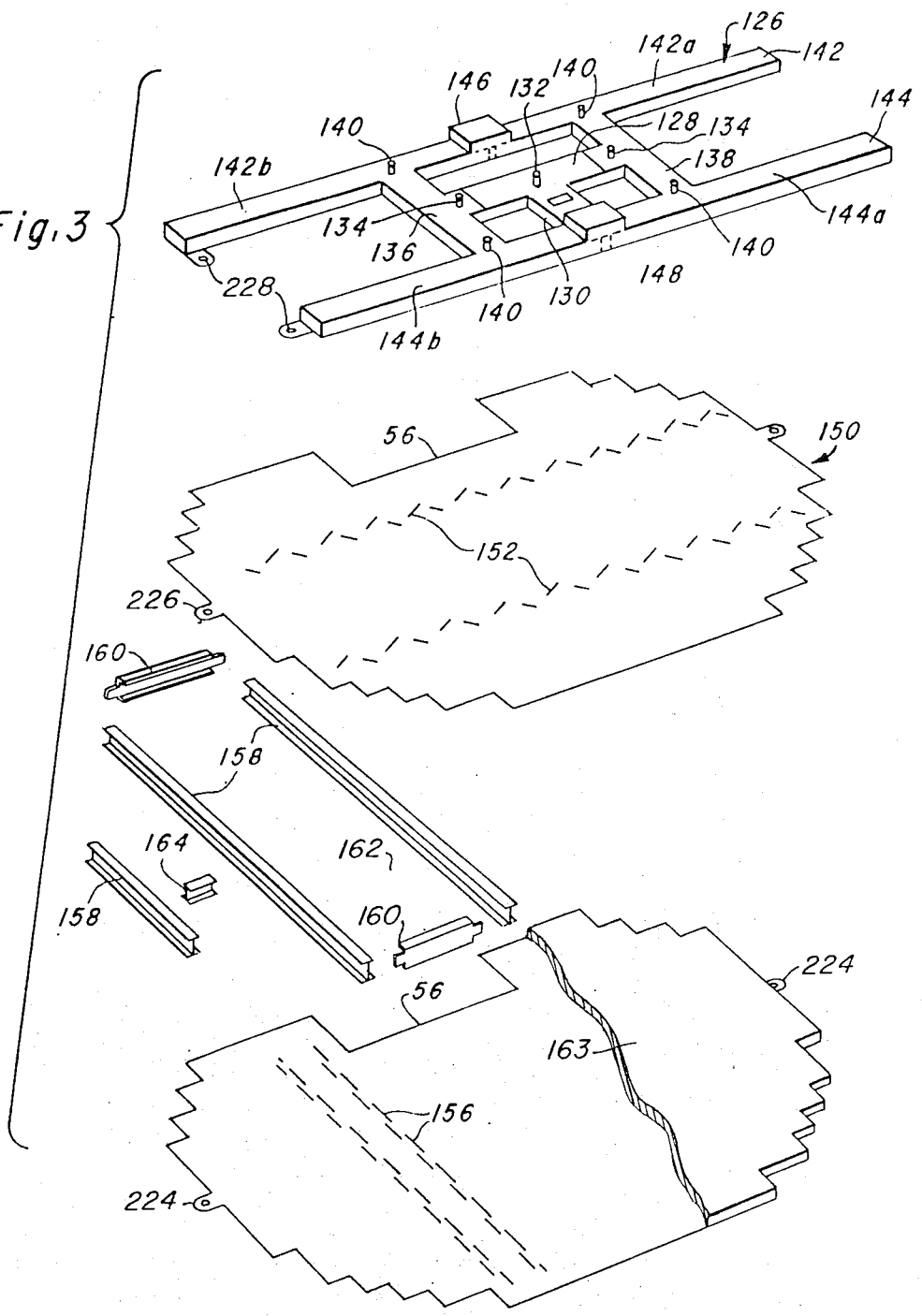
FIG. 3 is an exploded view of a flat plate antenna construction.
Figure 5:
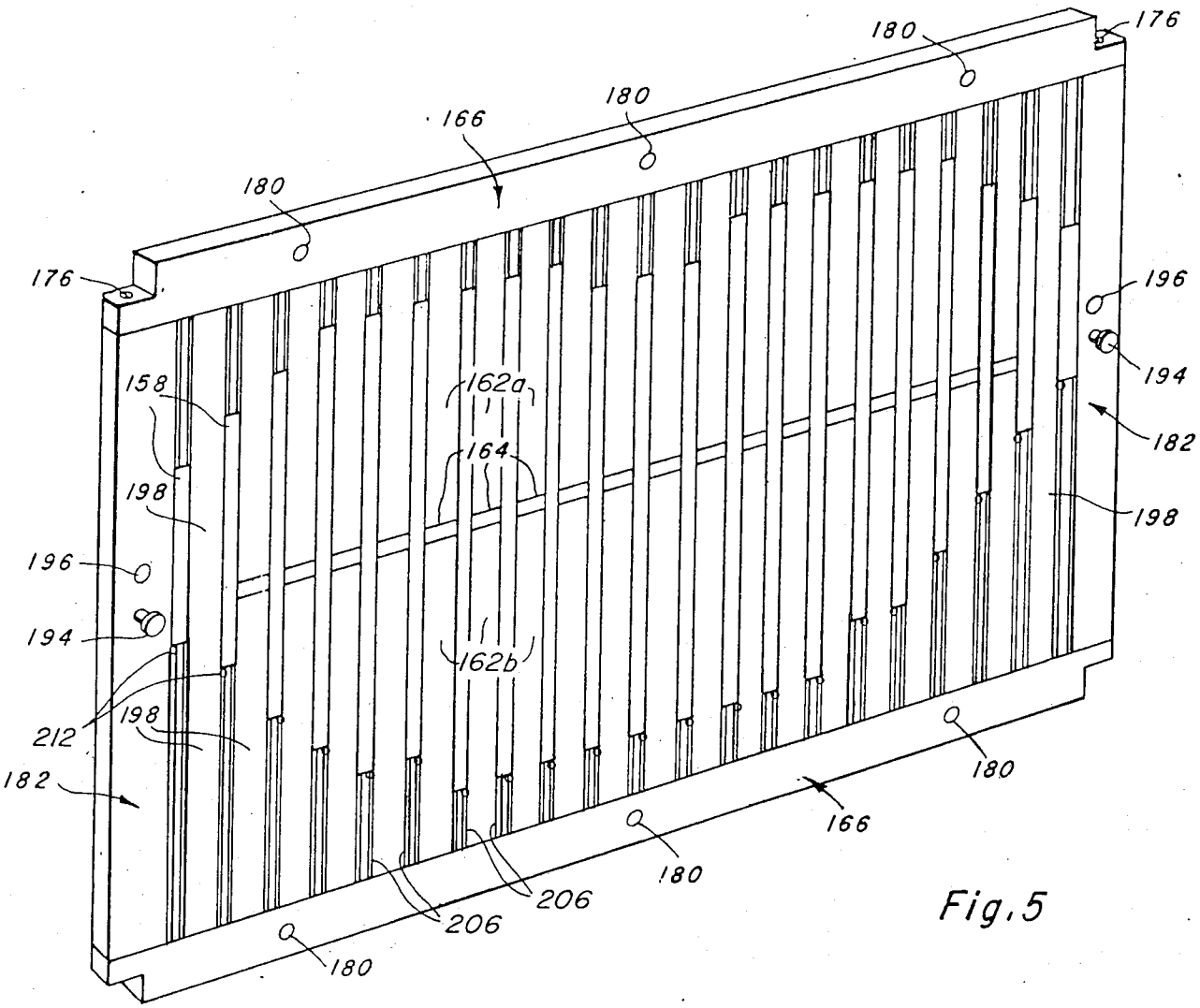
FIG. 5 is an isometric view of part of the flat plate antenna jig with components of the flat plate antenna properly positioned to be assembled with the front and back plates on a jig base to form the flat plate array having the desired geometry.

The flat plate array assembly, as shown in FIG. 3, has in addition to the manifold 126, a back plate 150, having a plurality of power coupling series slots 152, and a front plate 154, having a plurality of RF energy radiation shunt slots 156. The back and front plates are bonded, or otherwise attached, to a plurality of spaced, flanged beams 158, and end shorting members 160 to form a plurality of RF energy cavities 162 constituting the planar array antenna. Where a multiple (eight or more quadrant) feed manifold is used, a plurality of dividers 164 (internal short members) are used to divide each cavity 162 into a plurality of cavities 162*a*, 162*b* (FIG. 5).

The method of fabricating the flat plate array 54 is now described (FIG. 3). The back plate 150 is configured by etching or cutting or punching, preferably with a Wiedematic Punch, a thin (about 0.020") sheet of electrical conducting material such as a metal or metal clad material. If a metal such as aluminum is used, the surfaces are alodined to provide corrosion resistant surfaces. The desired number of power divider slots 152 can be punched or otherwise formed and the array outline cut in the back plate 150 at this time. A series slot is provided for each cavity 162*a* and 162*b* (FIG. 5). The angle of each series slot determines the amount of power coupled out of the manifold into the cavity.

The front plate 154 can be configured from the same material of like thickness used for the back plate and in the manner described for configuring the back plate with the exception that shunt slots 156 are punched or otherwise formed therein at that time. The size of the shunt slots and distance they are offset from the center line of their cavity determines the amount of RF energy radiated from the cavity. To prevent moisture from entering the antenna, and where necessary to pressurize the cavities to prevent arcing, the shunt slots are closed by bonding, or otherwise attaching, to the outer surface of the front plate a layer of RF energy transparent material 163 (FIG. 3) such as, for example, the plastic material sold under the trademark KAPTON by E. I. DuPont de Nemours and Company.

Figure 4:
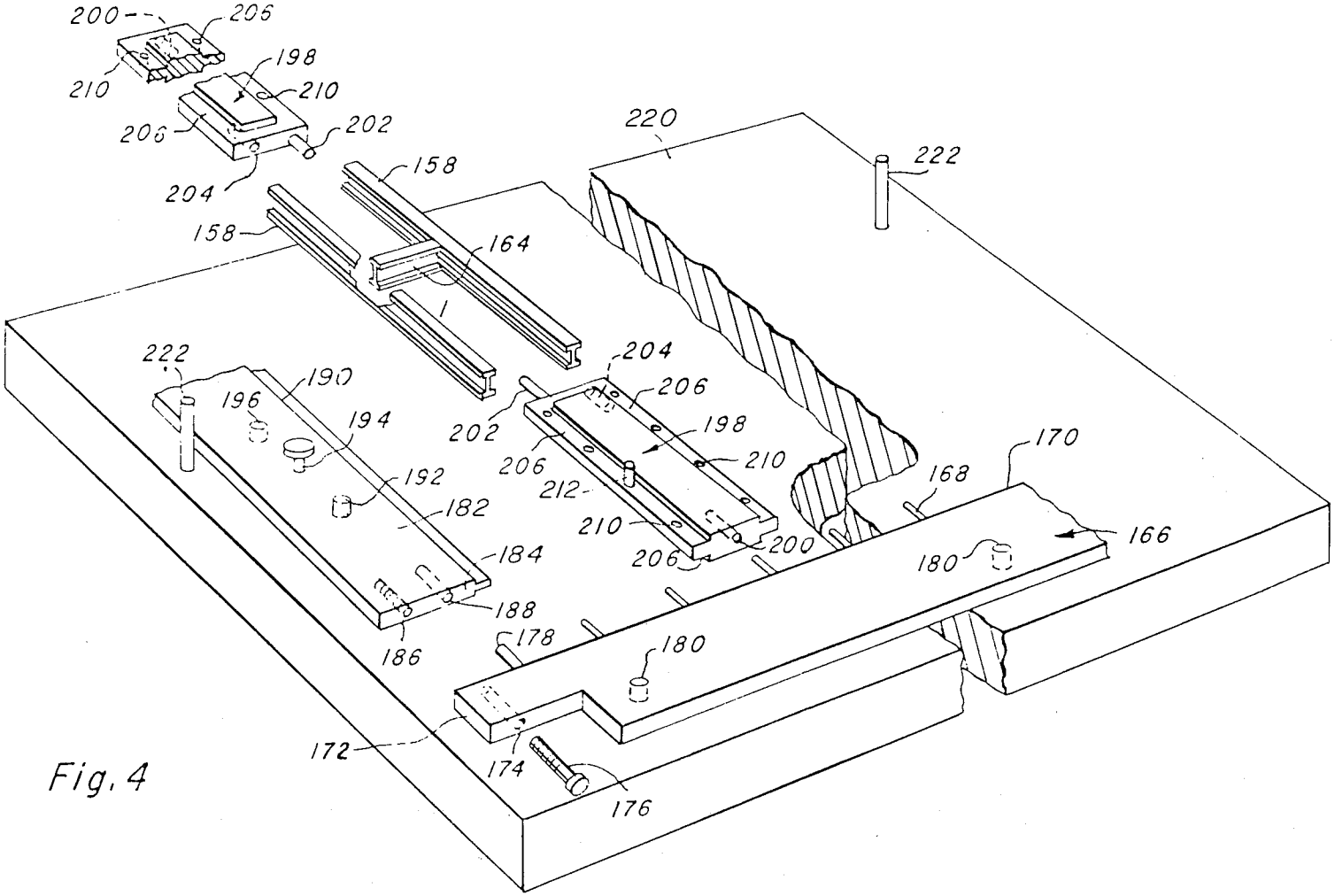
FIG. 4 is an exploded view of the flat plate antenna jig.

The cavities 162 of the flat plate antenna are formed using a special jig (FIG. 4). The special jig includes a frame comprising a base end alignment bar 166 having a plurality of numbered spaced cavity mandrel receiving pins 168 in a minor elongated surface 170. Ends of the base end alignment bar 166 have a reduced width 172 through which a connecting hole 174 passes to provide passage for a side support bar connecting socket head screw 176. A side bar joining pin 178 is embedded in the minor surface 170 adjacent to the connecting hole 174. A plurality of jig retaining holes 180 are drilled in the major surface of the end alignment bar 166.

A pair of side support bars 182, each having ends 184 with a threaded hole 186 and base pin receiving hole 188 to mate, respectively, with the socket head screw hole 174, and base side support bar retaining pin 178, are joined, in a selected spaced relationship, to the base bar 166 by the socket head screws 176. As each side bar and end thereof are mirror images in construction only a part of one bar 182 is shown. Each side support bar 182 has a recessed surface 190 on the inside edge, top and bottom. The recessed surfaces receive the outwardly extending flanges of the flanged beams to form a coplanar surface with the major surface of the side bars. The selected spacing of the side bars 182 is the width of the desired planar (flat plate) array. The top surface of each side bar 182 has a manifold positioning pin 192, a lift means such as a knob 194 and a hole 196 for receiving a base plate pin 222 for positioning the front plate, cavity forming jig, back plate and manifold on the base plate.

A plurality of cavity forming mandrels 198, of which only two are shown, are maintained in a spaced cavity forming relationship one to another by a plurality of holes and pins. Each mandrel has a hole 200 in one end mate with a pin 168 of the base bar 166 to position them in a spaced cavity forming relationship one to another. The other or opposite end of each mandrel has a pin 202 and a hole 204 equidistant from the center line of the mandrel; the top and bottom surfaces of this end of the mandrel are recessed in a direction transverse to the end to adapt it, when desired, to receive extending portions of flanges of a short section of flanged beam 164 between the hole and the pin. A second mandrel of the plurality of mandrels, so configured, can then be joined with the respective pins and holes of the mandrels mating to capture the short flanged beam and lock it into its correct cavity forming position. Each mandrel 198 is of a length substantially that of the desired cavity length and has guide rails 206 formed by recessing the mandrel top and bottom surfaces along the elongated opposing sides 208. When positioned in the frame each guide rail corresponds to the guide rail of an adjacent mandrel. Each guide rail bearing surface has a plurality of spaced holes 210 into which a stop pin 212 may be selectively inserted. The guide rails and stop pins of adjacent mandrels 198 properly position the flanged beams 158 for use in forming a cavity of desired width, depth and length for the array. The mandrels 198 described are of a length to coact with long flanged beams and the short flanged beams (internal shorts) to divide the array height into two equal parts, and provide open ended cavities for a four quadrant manifold. A top bar, corresponding in configuration to the base bar 166 is then attached to the side support bars and adjacent mandrels to complete the frame of the special jig (FIG. 5). Use of the special jig to facilitate fabrication of the planar array will now be described for a four quadrant feed manifold.

The base bar 166, side bars 182 and mandrels 198 are cleaned, a release agent applied, and the lower mandrels assembled with the base 166 and side bars 182. A suitable release agent is, for example, Johnson's liquid wax. The flanged beams 158, which may be, for example, aluminum I beams or H beams about 0.200" in height, for X-band, are cleaned. The top and bottom surfaces of each flanged beam is coated with a bond film primer such as, for example, the bond film primer sold by American Cyanamid Company. Strips of bond film with protective covering are cut to the flange width and length and stuck on the top and bottom surfaces of each flanged beam. The flanged beams are then inserted along the guide rails 206 until stopped by the stop pins 212 of the mandrels. Each flanged beam is of a length equal to the longest of the cavities it separates. Short pieces of flanged beams 164 corresponding in shape to the flanged beam 158 are then inserted transverse to the flanged beams as previously described. Each short piece of flanged beam forms one end or internal short for the cavities 162*a* and 162*b* (FIG. 5). Next, top mandrels 198 are inserted between the flanged beams 158 and a cleaned top bar attached to the side bars to complete a loaded jig frame. In this manner, the jig frame locks the flanged beam members into correct positions.

The planar array is then assembled on the base plate 220, which completes the special jig, as follows. The base plate 220 (FIG. 4) has at least two positioning pins 222 arranged to engage positioning holes 224, 196, 226 and 228, respectively, of the front plate, (FIG. 3) frame (FIG. 4), back plate and manifold (FIG. 3). First the back plate 150 is positioned on the base plate positioning pins 222, a templet (not shown) defining the flanged beam attachment areas placed thereon, and the flanged beam attachment areas coated with a primer. The templet and back plate are then removed. The back plate is set aside. Next, the front plate 154, with the KAPTON layer down, is positioned on pins 222, covered with a templet defining the flanged beam pattern, and the flanged beam areas coated with a primer. The protective covering over the bond film on the flanged beams is removed and the jig (FIG. 5) holding the flanged beams is positioned on positioning pins 222 (FIG. 4) and the back plate 150 is positioned on pins 222. A templet defining the manifold attachment areas is placed over the back plate and manifold attachment areas of the back plate, coated with a primer and the templet removed. After which manifold pieces, coated with a bonding primer and bonding material, are positioned on the back plate 150 over base and side bar pins 222 and 192 and pressure templets (not shown) inserted to make a solid block pattern thereof. The solid block pattern facilitates keeping the correct manifold position during final processing.

The assembled base plate is then inserted into a vacuum bag which is evacuated to about 5 torr to apply even pressure over the flat plate array assembly and heated in an oven for about one hour at a temperature required to activate the bond film such as, for example, between about 250° F. to 350° F. The heating bonds the front and back plates 154, 150 to the flanged beams 158, and shorts 164, and the manifold 126 to the back plate 150. After cooling to room temperature, the frame bearing the planar (flat plate) array antenna 20 is removed from the base plate 220, disassembled, and the mandrels 114 removed from the cavities 162*a* and *b*. To complete the cavities, the open ends of the cavities are closed by bonding or otherwise attaching the shorting members 160 to the ends of the flanged beam members 158 and the interior sides of the front and back plates.

Figure 6:
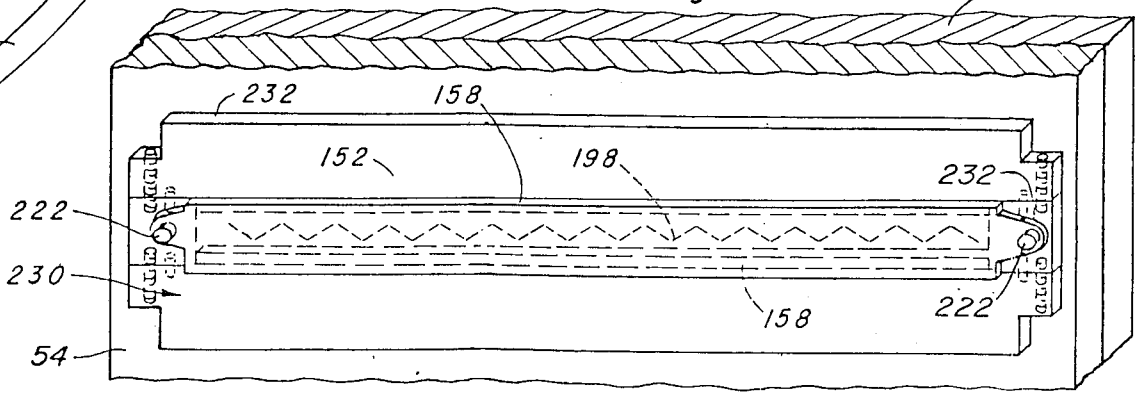
FIG. 6 is an isometric view of a modified manifold and jig.

In a modification of the preferred embodiment of the invention (FIG. 6), the manifold is fabricated using a jig 230 similar to the array forming jig. The manifold jig is adapted to overlay the array forming jig with the series slots of the array back plate positioned beneath mandrels 198 and between flanged beams 158 forming sides of the manifold. The top and bottom surfaces of the flanged beams have been primed, strips of covered bond material attached and the flanged beams inserted along guide rails of waveguide forming mandrels 158 to stop pins where they are captured and locked into position by the top plate of the frame. A primed cover plate 232 is then positioned on the base plate positioning pins 222 to cover the flanged beams. The double decked jigs and base plate are then placed in a vacuum bag, and the remaining steps performed as described previously for the preferred embodiment. After the array has been removed from the vacuum bag, the open ends of the manifold waveguides are closed with shorts 160 (FIG. 3).

Although a preferred embodiment of the flat plate antenna and method of fabrication only are disclosed, it will be appreciated by those skilled in the art that changes to the flat plate antenna and method of fabrication can be made without departing from the invention as claimed.

What is claimed is:

1. A method of fabricating a planar array antenna comprising:

(a) configuring an antenna back plate with a plurality of series slots from a sheet of antenna forming material;

(b) configuring an antenna front plate with a plurality of shunt slots from a sheet of antenna forming material;

(c) positioning the back plate on a jig base plate;

(d) positioning a cavity templet on the jig base plate to define flanged beam bonding areas on the back plate, and coating the flanged beam bonding areas of the back plate with a bonding primer;

(e) replacing the back plate with the front plate and positioning the cavity templet on the jig base plate to define flanged bonding areas on the front plate, and coating the flanged bonding areas of the front plate with a bonding primer;

(f) coating top and bottom surfaces of a plurality of flanged members with a primer coat, attaching strips of bonding material, and inserting them through the open end of a jig along a plurality of cavity forming mandrels to position the flanges of the flanged beams to mate with the flanged bonding areas of the front and back plates, and closing the open end of the jig to lock the flanged members and mandrels into position in the frame;

(g) positioning the jig carrying the flanged beams on the jig base plate over the front plate, and positioning the back plate, with the flanged beam area facing down, over the jig carrying the flanged beams;

(h) positioning a manifold templet on the jig base plate to define the manifold bonding area on one side of the back plate, coating the manifold area of the back plate with a bond primer, and removing the manifold templet;

(i) positioning the manifold on the back plate with the open faced waveguides facing down and in alignment with the primed manifold open faced areas of the back plate;

(j) placing pressure plates within areas defined by the manifold waveguides to lock the manifold components into position;

(k) placing the jig bearing the array into a vacuum bag and drawing a vacuum to exert a uniform force on the front and back plates;

(l) heating the bag to a bonding temperature to bond the manifold to the back plate, and the back and front plates to the flanged beams; and (m) removing the array antenna from the jig and the mandrels from the cavities of the array antenna and attaching shorting bars to close the open ends of the cavities of the array antenna.

2. A method of fabricating a planar array antenna according to claim 1 wherein each cavity formed is divided by inserting internal shorts after the plurality of cavity forming mandrels and flanged beams have been inserted, said internal shorts positioned to abut the ends of the plurality of flanged beam guiding mandrels, and locking the internal shorts in position by inserting additional cavity forming mandrels to abut the internal shorts.

* * * * *